United States Patent [19]

Archibald

[11] 4,135,852

[45] Jan. 23, 1979

[54] CENTRIFUGAL SLURRY PUMP AND METHOD

[75] Inventor: William R. Archibald, San Rafael, Calif.

[73] Assignee: McNally Mountain States Steel Company, Provo, Utah

[21] Appl. No.: 782,226

[22] Filed: Mar. 28, 1977

[51] Int. Cl.[2] ..... F04D 7/00

[52] U.S. Cl. ..... 415/199.3; 415/121 G; 415/213 A

[58] Field of Search ..... 415/199.3, 198.1, 213 A, 415/215, 121 G, 199.1, 1; 417/411, 424, 431

[56] References Cited

U.S. PATENT DOCUMENTS

| | | | |
|---|---|---|---|
| 1,629,141 | 5/1927 | Benson | 415/199.3 |
| 2,041,999 | 5/1936 | Hait | 415/198.1 |
| 2,491,751 | 12/1949 | McGee | 417/424 |
| 3,017,837 | 1/1962 | Judd | 415/199.3 |
| 3,322,070 | 5/1967 | Glass | 415/213 A |
| 3,440,968 | 4/1969 | Jensen | 415/199.3 |
| 3,759,628 | 9/1973 | Kempf | 415/213 A |
| 3,844,540 | 10/1974 | Dobbs | 415/121 G |

FOREIGN PATENT DOCUMENTS

| | | | |
|---|---|---|---|
| 2048087 | 5/1971 | Fed. Rep. of Germany | 415/213 A |

*Primary Examiner*—C. J. Husar

*Attorney, Agent, or Firm*—Flehr, Hohbach, Test, Albritton & Herbert

[57] ABSTRACT

A multiple stage centrifugal pump for the handling of slurries. At each stage the slurry enters and is centrifugally discharged from an unobstructed chamber in which a vortex is created by an impeller disposed in a cavity located above the chamber. The various flow passages are such as to minimize clogging under various conditions. Also a method making use of such a pump, the method being characterized by each stage being provided with an unobstructed vortex chamber which receives slurry through an axially disposed inlet, and in which vortical or swirling movement is induced by the operation of an impeller located in a cavity overlying and in communication with the vortex chamber. The material in the vortex chamber is centrifugally discharged and directed to flow upwardly and inwardly, and is discharged in an axial direction into the vortex chamber of the next stage. A bearing lubrication arrangement in which liquid under pressure is continuously being passed through the bearings and discharged into the material being pumped.

10 Claims, 7 Drawing Figures

CENTRIFUGAL SLURRY PUMP AND METHOD

BACKGROUND OF THE INVENTION

This invention relates generally to pumps and pumping methods for the handling of slurries. Various pumps have been used for the handling of slurries, including positive displacement pumps of the cylinder-piston type. Another type of positive displacement pump for this purpose is known as the Moyno (trademark) pump, and is shown for example in U.S. Pat. No. Re. 21,374 dated Feb. 27, 1940 and U.S. Pat. No. 2,555,136 dated Apr. 25, 1950 which are of the progressive cavity type. Another type of pump makes use of a tube or pipe made of resilient material, the ends of which form inlet and discharge openings. A driven roller is arranged to collapse the tube while being driven from the inlet toward the discharge end, thereby progressively displacing the material within the tube. For certain services, the above types of pumps have disadvantages. For example, a pump of the cylinder-piston type or collapsible tube type produce pulsations or surges in the discharge, and this may be detrimental to piping and other equipment to which the pump is connectioned. Such pulsations or surges can be minimized by the use of surge preventators, but this increases space requirements and involves additional expense. Pumps of the Moyno type are not subject to serious pulsations in the discharge, but when driven relatively high speeds they are subject to mechanical vibration.

Centrifugal pumps have been used to some extent for handling slurries. The more common pump of this type employs an impeller which acts directly upon the material to impart the necessary rotary motion. In other words, either the impeller is provided with radially extending channels through which the material flows to attain the desired rotary motion, or the impeller is provided with vanes and operates within a relatively closely fitted housing. Pumps of this type likewise have disadvantages when used for handling slurries, particularly when a plurality of stages are provided to attain a desired pumping head. They are subject to clogging under certain operating conditions, and they are subject to serious abrasion due to the direct action of the impeller upon the slurry.

Another type of centrifugal pump has been developed for use on slurries, namely one of the vortex type. With such a pump, the impeller does not act upon all of the slurry passing through the pump housing. Centrifugal force is induced within a vortex chamber which communicates with the inlet and discharge outlets of the pump, by use of an impeller which is located at one side of the chamber and which induces vortical movement by hydraulic coupling. Examples of such pumps are disclosed in U.S. Pat. No. 3,294,026, dated Dec. 27, 1966, and U.S. Pat. No. 3,759,628, dated Sept. 18, 1973. Such pumps are not of the multi-stage type, and therefore they are not capable of producing relatively high discharge heads such as is frequently desired. Furthermore the multi-staging of such pumps involves certain problems, particularly if a pump is desired having high performance with respect to developed head and pumping capacity, and if a compact overall assembly is desired which can be installed where space requirements are limited.

SUMMARY OF THE INVENTION AND OBJECTS

In general, it is an object of the invention to provide an improved slurry pump of the vortex type.

Another object is to provide a slurry pump of the above character having relatively high performance with respect to the hydraulic head developed and pumping capacity, and which is relatively compact.

Another object is to provide a multi-stage slurry pump of the vortex type which can be operated at high speed without undue abrasion of the working parts, and which has high performance with respect to developed head and pumping capacity.

Another object is to provide a multi-stage slurry pump which is not subject to clogging under various operating conditions.

Another object is to provide a slurry pump of relatively simple construction having parts that can be readily disassembled for repair or replacement.

In general, the present invention consists of a centrifugal slurry pump having (when disposed in upright position) at least two stages disposed one above the other and arranged along a predetermined axis. Each stage consists of a stationary annular bowl-shaped housing disposed symmetrically with respect to the axis of the pump. A drive shaft is coincident with the pump axis, and bearing means is provided for journalling the shaft. Each housing has a lower end or bottom wall through which the shaft extends. The housing also includes annular side walls, the lower portions of which extend upwardly from the peripheral margin of the bottom wall, and upper wall portions which converges upwardly to the bottom wall of the next upper housing. The upper end of each housing forms a discharge passage for delivery of slurry to the next upper housing. Each housing forms an unobstructed vortex chamber surrounded by the lower portions of the housing side walls. Structural means is disposed above the vortex chamber of each housing and is formed to provide an annular cavity of a diameter less than the diameter of the vortex chamber, the cavity having its open side faced downwardly toward the vortex chamber. An impeller is disposed in each such cavity and is fixed to the shaft. The structural means together with the side walls of the housing form an annular passage extending upwardly from the periphery of the vortex chamber to the upper end of the housing. Flow directing means are provided for directing the rotating flow in the annular flow passage of slurry in a direction upwardly from the periphery of the vortex chamber and then upwardly and inwardly to discharge slurry from the upper end of the flow paths in a direction generally parallel to the axis of the shaft. Rotation of the impellers induces rotation of slurry in the vortex chambers by virtue of hydraulic coupling whereby the centrifugal force thereby developed causes slurry from each stage to be discharged upwardly through the annular flow path and into the next upper stage. The inlet opening of the lowermost stage forms the pump inlet, and the discharge outlet from the uppermost stage forms the pump outlet. The method involves creating vortical movement of slurry in the vortex chamber of each stage by hydraulic coupling with an impeller, with discharge of material from the periphery of the shaft, the vortex chamber of the next upper stage receiving such discharge in its central region.

Additional objects and features of the invention will appear from the following description in which the preferred embodiment has been set forth in detail in conjunction with the accompanying drawings.

DESCRIPTION OF THE PREFERRED EMBODIMENT

Figure 1:
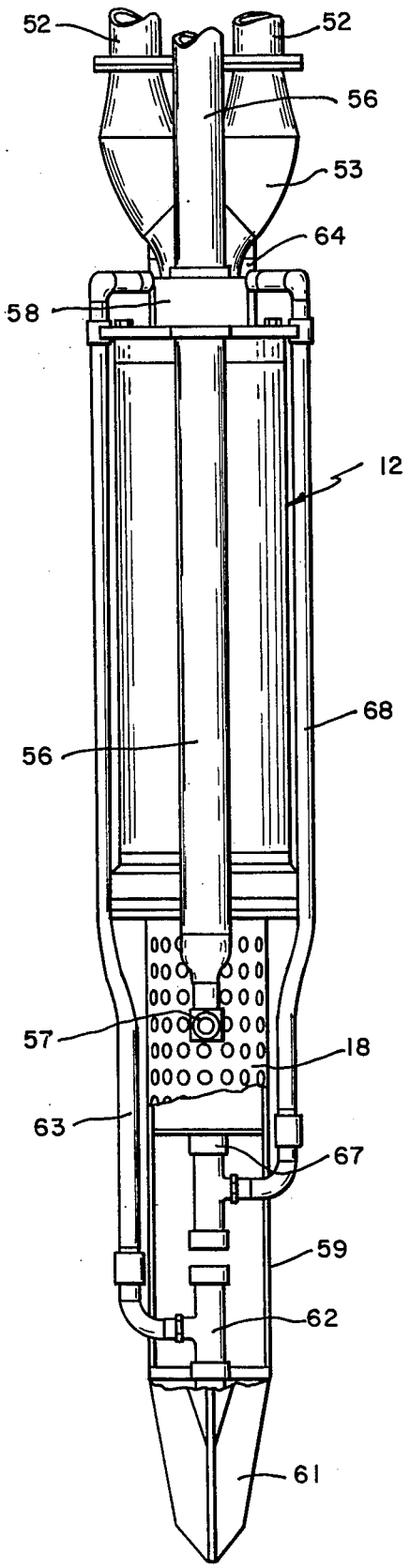
FIG. 1 is a side elevational view illustrating apparatus which incorporates a pump made according to the present invention.
Figure 2:
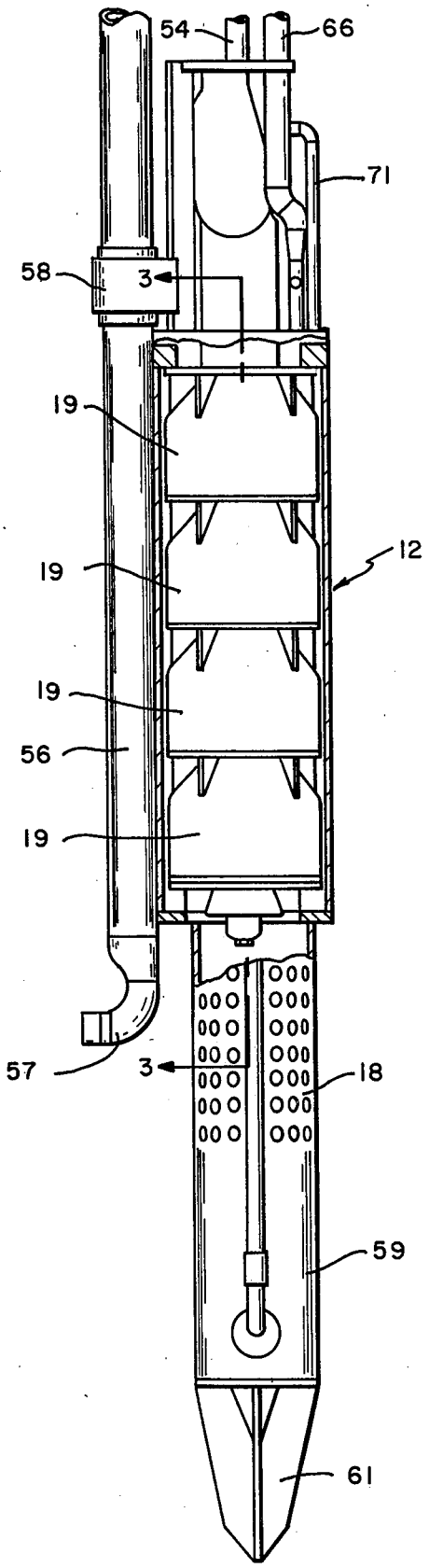
FIG. 2 is a partially broken-away elevational view of the apparatus of FIG. 1.

FIGS. 1 and 2 illustrate the pump incorporated as a part of an underground mining system such disclosed in U.S. Pat. No. 3,797,590 dated Mar. 19, 1974. It should be understood however that the invention can be incorporated with other pieces of equipment and in other systems. The slurry pump incorporated in the apparatus of FIGS. 1 and 2 is indicated generally at 12, and the entire assembly unit of which the pump is a part is adapted to be supported at the lower end of a string of piping extending down a well bore or other opening from a suitable surface tower or platform (not shown) at the surface of the ground.

The pump 12 in this instance includes an outer shell or casing 13 having mounting flanges 14 and 15 secured to its upper and lower ends. The upper flange 14 serves to mount the closure plate 16, and the lower flange 15 serves to mount a flanged ring 17 which may carry the perforated suction cannister 18. Within the casing 13 there is a plurality of pumping stages, the lowermost and uppermost stages being designated A and B, it being understood that additional stages may be interposed between the stages A and B. The lowermost stage A consists of a bowl-shaped housing 19 which may be an iron casting (such as ni-Hard, available from Olympic Foundary, Seattle, Wash.), and which includes a bottom wall 21 together with side walls 22. A peripheral margin of the bottom wall 21 is shown mounted upon the upper face of the ring 17. The portion **22*a* of the side walls is preferably generally cylindrical and extends upwardly from the peripheral margin of the bottom wall 21. The upper portion 22*b* of the side walls merges with the lower side walls 22*a*, and extends upwardly and inwardly. In general, the wall portion 22*b*** is conical shaped and is upwardly convergent toward the central axis of the pump.

A drive shaft 23 is coincident with the vertical pump axis, and extends through the housings of each of the stages. The shaft may be constructed of any suitable material such as SS 304 steel. The portion of shaft near the upper end of the casing 13 is shown journalled by the bearing 24, and the lower end of the shaft is journalled by the bearing 25 which is carried by the bottom wall 21 and protected by a shroud 26. An annular wall 27, which forms the bottom wall of the next higher housing, is secured to the upper end of the side wall portion **22*b* of stage A, and is provided with an annular outlet passage 28 surrounding the shaft and communicating with the space within the next upper stage. The bottom wall of the lower stage A is provided with an annular inlet 29 which communicates with the flow passage 31 of the suction bell 32. The flow passage 31 is preferably provided with anti-swirl vanes 33**.

Figure 4:
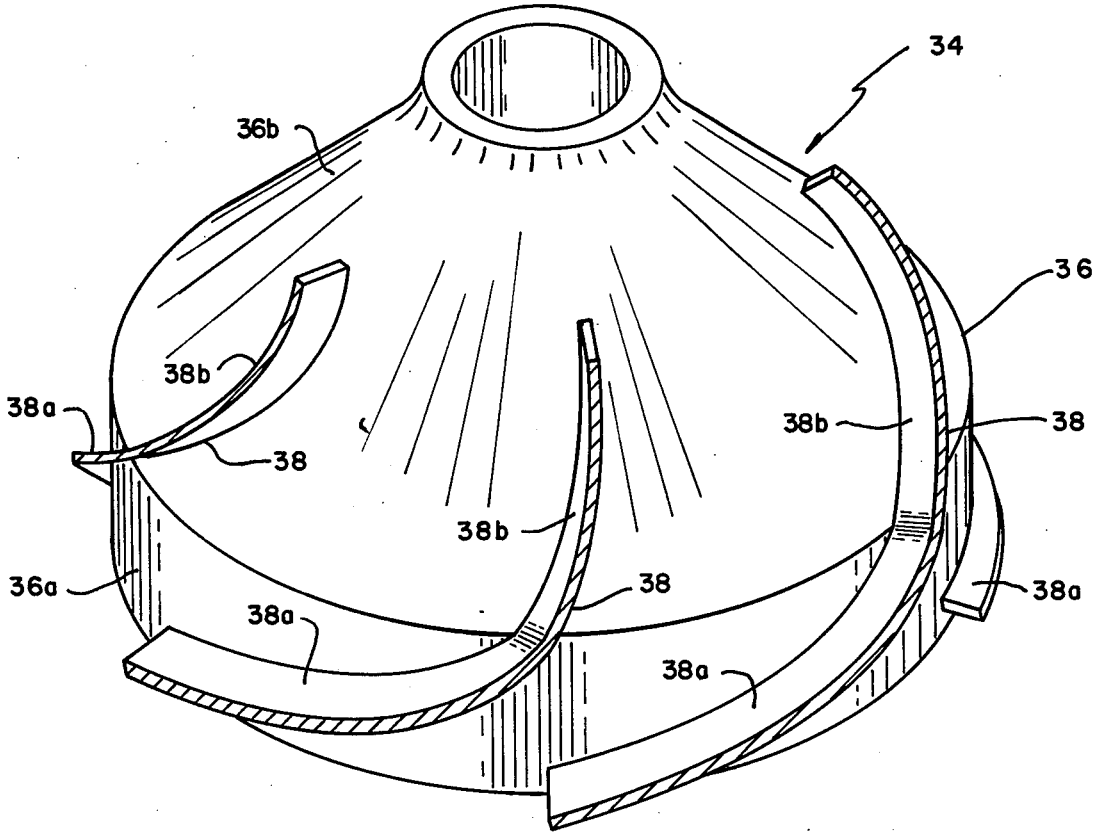
FIG. 4 is a perspective view of a portion of the inner structure for one pump stage, illustrating the flow directing means.

Mounted within the bowl-shaped housing of each stage there is an inner structure 34 which is fixed to the side walls of the outer housing. This inner structure includes annular walls 36 forming the lower portion **36*a* and the upper conical shaped portion 36*b* which converges upwardly from the lower portion 36*a* to the shaft. The spacing between the side portions 22*a* and 22*b* of the outer housing 19 and the portions 36*a* and 36*b* of the inner structure, forms the annular flow passage 37 which extends upwardly from the lower edge of the portion 36*a* to the annular outlet opening 28. It will be evident that as the flow passage 37 converges toward the shaft 23, the effective cross-sectional flow area gradually decreases. Flow directing vanes 38 are provided within the passage 37 and are best shown in enlarged FIG. 4. The lower vane portions 38*a* extend helicoidally about the lower portion 36*a* of the inner structure. The portions 38*b* are bent whereby their upper ends terminate in planes substantially parallel and coincident with the axis of the shaft 23. In practice, the vanes 38 are fixed to both the walls forming the portions 22*a* and 22*b* of the housing, and to the walls forming the portions 36*a* and 36*b* of the inner structure. In this connection, the walls forming portions 22*a* and 22*b* together with the walls of the inner structure may be made as one casting, which includes the vanes 38**.

Each of the bowl-shaped housings 19 is constructed to provide a vortex chamber 41 in its lower portoin. Overlying each vortex chamber 41 there is an annular cavity 42 formed in the inner structure, which is surrounded by the portions **36*a*, and which has its open side faced downwardly. An impeller 43 is disposed within the cavity of each stage and is fixed to the adjacent portion of the shaft. Each impeller can consist of an annular plate 44 together with vanes 45** that are secured to the lower side of the plate. The vanes extend radially and serve to impart intense rotary motion to material within the cavity.

The axial extent of the vanes is limited so that they are contained and concealed wholly within each respective housing 34 and therefore out of direct contact within the vortex chamber. In this way stoppage of the pump and restart may be accomplished without blockage which might otherwise be caused by interference from settled solids. The impeller can be constructed of ductile iron coated with polyurethane on all wear surfaces, or ni-Hard steel.

The lower stage and each of the intermediate stages, if any, have their inner structures serving to support bearings 46 for journalling the shaft.

The wall 27 at the upper end of the uppermost stage B is shown engaged by the ring 14 whereby the entire assembly of the housings and inner structures are clamped together as a unitary assembly. The annular discharge opening 28 of stage B communicates with the pipe fitting 48 which forms the outlet flow passage 49 of the pump. The housings for all of the stages may be reinforced by webs 50.

Operation of the pump described above is as follows. Shaft 23 may be directly coupled to a driving motor, as for example an electrical motor operating at a usual speed such as 1750–1800 rpm or through a variable operational hydraulic control coupling. Piping for conveying the discharged slurry is coupled to the fitting 48. Assuming that the pump is in normal operation, for each of the stages the impeller 43 imparts intense rotary motion to the material within the cavity 42, and by virtue of hydraulic coupling with material in the corresponding vortex chamber 41, vortical movement is imparted to the material in chamber 41. By virtue of the developed centrifugal force, the slurry is forced to flow through the flow path 37 between the housing 19 and the inner structure 36, and this material is discharged with increased velocity through the annular outlet 28 into the next pumping stage. As the material flows upwardly and inwardly through the flow passage 37, its direction is changed by the action of vanes 38. The vane portions **38*a* serve to direct the material upwardly, and the vane portions 38*b* change the direction of flow whereby for the upper portion of the flow passage, the direction of flow is inwardly toward the shaft and generally parallel to the shaft axis. In other words, when the material is discharged from the flow passages 37 through the outlet 28, the direction of flow is primarily parallel to the shaft. Immediately upon entering the vortex chamber 41 of the next higher stage, rotary or vortical motion is induced in the body of material by virtue of the hydraulic coupling between the material in the chamber and the material being intensely rotated by the impeller 43**. As the material progresses through each stage, additional hydraulic head is developed whereby when discharged from the uppermost or last stage, the head is of the order desired and is sufficient to lift the slurry for discharge at a desired elevation.

In the event the pump should be shut down with the pool of slurry at the lower end of the pump being sufficient to maintain slurry within the pump, solid matter of the slurry will settle out in each of the stages. Most of the settled material will accumulate within the chambers 41, although some from one vortex chamber may find its way downwardly into the next lower stages. When the pump is started in operation following a shutdown period, the swirling or vortical action within each of the chambers 4 serves to repulp such settled solids, and the pump will function without clogging.

In the event the pump is shut down without a head of slurry such as is capable of maintaining slurry within the pump, the material will drain downwardly until slurry has been drained from all of the stages. Here again no plugging or clogging will occur.

In the event it is desired to dismantle the pump for the purpose of replacing or repairing certain of the working parts, this can be done by removing the clamping ring 17, whereby the entire inner assembly comprising the shaft, the impellers, the inner structures 36, and the housings 19, may be removed as an assembly unit from the lower end of the casing.

The various bearings for journalling the shaft 23 may be lubricated in any suitable manner, depending upon their construction. In the event the bearings are of the type requiring water lubrication, suitable means can be provided, such as ducts leading from the bearings, and by means of which water can be supplied to the bearings during operation of the pump.

Figure 5:
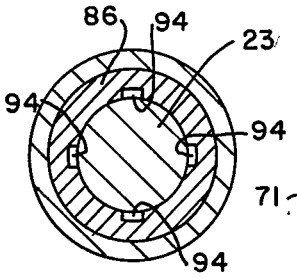
FIG. 5 is a cross sectional view taken along the lines 5 — 5 of FIG. 3.
Figure 6:
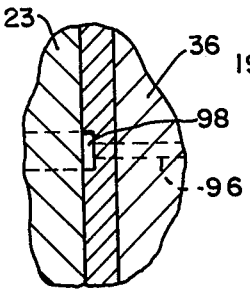
FIG. 6 is an enlarged cross sectional view taken along the lines 6 — 6 of FIG. 3.
Figure 3:
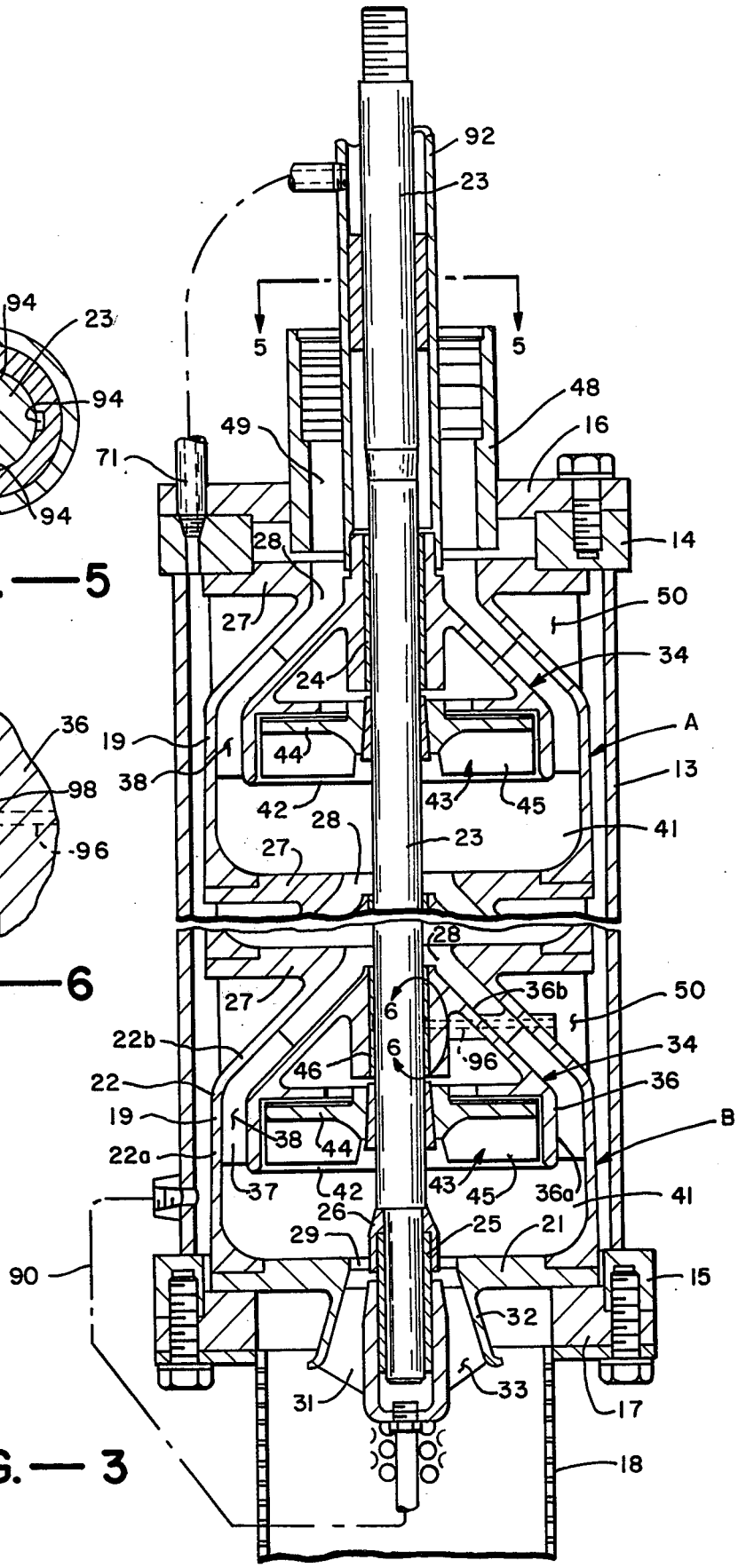
FIG. 3 is an axial section view of the pump, taken along the line 3 — 3 of FIG. 2.

In applications of pumps constructed in accordance with the present invention for particular use in slurry pumping, the present construction provides particular features which enable its operation with considerably contaminated materials and without harm to the bearings. In that case, for example, a bearing having a substantial clearance of the order of 0.006–0.008 of an inch may be employed in which pressurized water is delivered to each bearing in such a way that it is discharged into the media being pumped. The following relates to the structures shown, particularly in FIGS. 3, 5 and 6 and to the use of the pump in operation with slurries whose liquid phase is water. Thus, as shown particularly in FIG. 3, water under pressure may be delivered to the outermost upstream and downstream ends of bearings 25, 86, via piping 90, 92. These bearings as shown in FIG. 5 are provided with axially extending spline grooves 94 (cutless bearings) so that water delivered to one end continuously passes through the spline grooves 94 of the bearing and around the shaft during operation and is ultimately discharged within the pump housing itself and into the material being pumped. As shown in FIGS. 3 and 6, each intermediate bearing 46 is provided with an axial support which connects to region 50 surrounding the pump through bore 96 in which region water under high pressure is maintained. Intermediate bearings 46 are provided with a circumferential recess 98 at an intermediate portion thereof so that water under pressure passes around the shaft and outwardly from each end of each intermediate bearing and into the various chambers being used for pumping. The pressure of water that need be supplied to each bearing need be no greater than a reasonable amount more than the head developed by the pump in order for the bearings to be effective. By way of further example, a bearing material in one embodiment was made of nonmetallic fiberglass impregnated epoxy with the aforementioned clearances. However, other bearing materials may find use such as polyurethane impregnated with polydi-sulfide and teflon bronze.

When the pump is incorporated with apparatus such as shown in FIGS. 1 and 2, which is suitable for use in the bore of an earth well, the upper end of the pump is connected to piping 52, which may extend to the surface of the well. The piping is connected to the pipe fitting 48 of the pump by the transition section 53. It is assumed that the pump in this instance is constructed as shown in FIG. 3, except that it incorporates four stages. The upper end of the pump shaft is coupled to a shaft 54 which extends to the ground surface, where it may be directly coupled to a suitable driving motor. Assuming that the apparatus includes a hydraulic jet and is used to disintegrate a friable subterranean formation to form a slurry in the manner disclosed in said U.S. Pat. No. 3,797,590, a pipe 56 extends downwardly along one side of the pump and its lower end is provided with a jetting nozzle 57 which can be used to direct a jet of water laterally into the surrounding formation. Pipe 56 extends to the surface of the well where it is coupled to a suitable clamp for delivering water at relatively high pressure to the nozzle. Preferably the arrangement is such that the pipe 56 may turn or slide within the support 58, thereby permitting the pipe 56 and nozzle 57 to be oscillated or rotated and to be lowered or raised relative to the location of the pump.

The cannister 18 is shown provided with a tubular extension 59 which at its lower end carries the spade 61. A nozzle 62 is arranged to discharge a downwardly directed jet of water in the region of the spade to assist in sinking the same into an underlying formation. Nozzle 62 connects with the pipe 63 which leads to a water manifold 64. This manifold is connected to a source of water under pressure at the surface of the well by pipe 66. A flush nozzle 67 is shown connected with the lower end of the cannister 18, and water is supplied to this nozzle by pipe 68, which likewise connects with the manifold 64. The pipe 71 is provided for supplying water under pressure to the lower and intermediate bearings of the pump shaft.

Operation of the apparatus shown in FIGS. 1 and 2 is as follows. The entire assembly is lowered by the piping 52 through the bore of a well until the pump and the jet nozzle 57 are within the formation to be mined. For example, this formation may comprise tar sands or other friable ore. Assuming that the piping 52 is suitably connected to pumping means at the surface of the well, and that the pump shaft is coupled to a suitable driving motor, the pump is started in operation and the jet 57 supplied with water under pressure to impinge upon the surrounding friable formation. This jetting action, which may be accompanied by oscillating the nozzle 57 and with raising and lowering of the nozzle, serves to pulp the surrounding friable formation, with the result that pulp flows into the well and into the pump through the perforated cannister 18. The pump functions as previously described to develop a discharge head sufficient to deliver the pulp at the surface of the well. In the event the perforations of the cannister 18 should become clogged, the nozzle 57 can be turned 180° from the direction shown in FIGS. 1 and 2 to discharge directly against the adjacent side of the cannister, thus flushing away accumulated solids. Also the perforations of the cannister can be cleared by supplying water to nozzle 67. Also in the event the pump is to be shut down, immediately prior to stopping the driving motor, the jet can be turned to discharge against the cannister and water can be supplied to nozzle 67, thus providing additional water to the suction side of the pump, with the result that at the time the pump is stopped, the material retained within the pump and in piping 52 has a materially reduced solids content.

Figure 7:
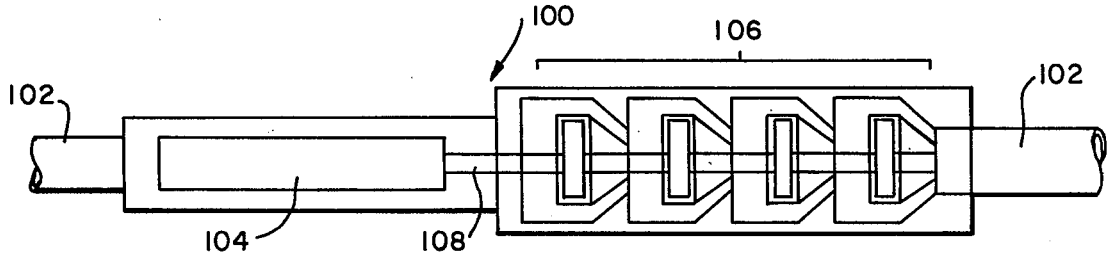
FIG. 7 is a schematic view of a pump constructed in accordance with the present invention for use as an inline booster pump for pipe lines.

While the disclosure herein has been made, described and claimed with respect to the orientation of vertical and horizontal, these terms should be taken as generalized and as an aid to facilitate explanation of the structure and operation of the pump disclosed. It should be understood, however, the pump may be used in various orientations. For example, the pump may be disposed and operated in applications in slant hole drilling where it is neither positioned horizontally nor vertically. It may also, for example, be disposed with its axis of conjoint rotation of the impellers located along a horizontal line as in fast flow pipeline work. Such an application is illustrated in FIG. 7 of the drawings in which the pump and drive means 100 is disposed in a pipeline 102. As shown, the pump 106 is aligned with the pipeline and maintains a continuous flow path therewith. A suitable submersible motor 104 which may be electrically driven is also incorporated in the pipeline and connected through shaft 108 to the pump. Thus the drive motor is directly connected to the drive shaft 108 to thereby conjointly drive the impellers and pump. In such applications there may be a need to change certain of the bearing mounting structures so as to be able to support the weight of the shaft and impeller in an appropriate manner. Accordingly, to the extent the terms horizontal and vertical are used herein, they should be taken in a relative sense as explained.

What is claimed is:

1. A centrifugal liquid or slurry pumping apparatus having at least two aligned pumping stages, the apparatus when disposed in upright position comprising first lower and second upper stationary annular bowl-shaped housings disposed symmetrically along a predetermined axis of the pump, a drive shaft coincident with said axis, bearing means for journalling the shaft, the housing of each stage having a bottom wall through which the shaft extends, each of said bottom walls having an annular inlet opening surrounding the shaft, each housing having annular side walls, the lower portion of the side walls extending upwardly from the peripheral margin of the corresponding bottom wall and the upper portion of the side walls being upwardly convergent from the lower portion to the bottom wall of the next upper housing, the upper end of each housing forming a discharge passage for delivering slurry through the inlet opening of the next upper housing, each housing being formed to provide an unobstructed vortex chamber surrounded by the lower portion of the side walls, structural means disposed above the vortex chamber of each housing forming an annular cavity of a diameter substantially less than that of the vortex chamber and having its open side faced downwardly toward the vortex chamber, an impeller disposed in each such cavity and fixed to the driving shaft, said structural means together with the side walls of the housing forming an annular flow path extending upwardly from the periphery of the vortex chamber to the upper end of the housing, and flow directing means for directing flow of slurry in said path in a direction upwardly from the periphery of the corresponding vortex chamber and then upwardly and inwardly to discharge slurry from the upper end of the flow paths in a direction generally parallel to the axis of the shaft.

2. Pumping apparatus as in claim 1 in which the structural means is a structure fixed to the surrounding side walls of the housing, said structure having bearing means for journalling the shaft.

3. Pumping apparatus as in claim 1 in which the impeller for each housing comprises an annular plate and radially extending vanes secured to the lower side of the plate.

4. Pumping apparatus as in claim 1 in which the upper end of the lowermost housing is secured to an annular wall forming the bottom wall of the next upper housing.

5. Pumping apparatus as in claim 1 in which the housings are assembled and enclosed within an elongated casing, the casing having means at its ends for engaging the assembly of housings.

6. Pumping apparatus as in claim 1 in which the inner structural means consists of walls that are annular and which surround the cavity and walls which converge upwardly toward the shaft, said flow passage being formed between the side walls of the housing and the walls of the inner structure.

7. A method for the pumping of liquid or slurry making use of a centrifugal slurry pump having at least two pumping stages disposed along a central axis, each pumping stage when the pump is upright comprising housing means forming a lower vortex chamber, structural means disposed above the vortex chamber of each housing forming an annular cavity of a diameter substantially less than that of the vortex chamber and having its open side faced downwardly toward the vortex chamber, and a rotary impeller disposed in each such cavity, said structural means together with the side walls of the housing forming an annular flow path extending upwardly from the periphery of the vortex chamber to the upper end of the housing; the method comprising rotating the impellers to apply intense rotary movement to the material in said cavities, whereby vortical movement is applied to the material in the vortex chambers by hydraulic coupling with development of centrifugal force, causing the liquid or slurry to be continuously supplied to a central region of the vortex chamber of the first stage, causing material from the peripheral portion of the vortex chamber of the first stage to be delivered downstream about said corresponding structural means and then axially and inwardly to be discharged into the central portion of the vortex chamber of the next second stage in a direction generally parallel to the axis, and causing material to be delivered by centrifugal force from the periphery of the vortex chamber of the second downstream stage with flow of such material about the corresponding structural means and then inwardly for discharge adjacent to said axis, the flow from the vortex chamber of each stage about the structural means and then inwardly for discharge from that stage being directed whereby the discharge is substantially parallel to the axis of the pump.

8. A pump for use with liquids or slurries, comprising the combination of means forming a plurality of pump stage housings disposed in series along an upright longitudinal axis of the pump, each housing being formed with slurry inlet and outlet openings at axial opposite ends thereof, the outlet of each upstream housing discharging into the inlet of the housing immediately downstream thereof, a drive shaft extending through said housings, bearing means for rotatably mounting said shaft, an impeller mounted in each housing and on said shaft for rotation about said axis, means forming an annular cup-shaped shroud in each housing disposed in close-spaced relationship from one axial face of each impeller and surrounding the entire periphery of each impeller, with the opposite axial face of each impeller being exposed to slurry in a suction zone formed within the respective housing, drive means for rotating the shafts and impellers about the axis to create within each suction zone a rotating vortex of the liquid or slurry, and channel means in each housing having a generally circular opening about the rotating vortex of liquid or slurry for directing the same along a path extending radially inwardly and axially toward the outlet of the respective housing, said one axial face of each impeller being generally planar and disposed generally horizontally, and with the cup-shaped shroud opening downwardly about the respective impeller whereby upon pump shutdown the shroud precludes any particulate material in the housing from compacting inside the impellers whereby such impellers are free to be rotated to facilitate restarting of the pump.

9. A pump as in claim 8 which includes flow-directing vane means in the channel means of each housing for changing the direction of the rotating vortex of liquid or slurry to an downstream axial direction toward the respective housing outlet whereby at each pump stage a portion of the velocity head of the rotating slurry is converted to pressure head.

10. A pump as in claim 9 in which the vane means comprises a plurality of circumferentially spaced vanes within the channel means and with each vane having a generally spiralhelix upstream configuration oriented to receive vortex rotating liquid and thereafter converging conically and becoming more axially directed as they approach the downstream outlet.

* * * * *